US005481896A

United States Patent [19]

Yanagimoto

[11] Patent Number: 5,481,896

[45] Date of Patent: Jan. 9, 1996

[54] KNIFE BENDING APPARATUS

[75] Inventor: Chuji Yanagimoto, Yao, Japan

[73] Assignee: Itami Industrial Co., Ltd., Yao, Japan

[21] Appl. No.: 74,544

[22] Filed: Jun. 11, 1993

[30] Foreign Application Priority Data

Jun. 11, 1992 [JP] Japan ..... 4-151874
Jan. 8, 1993 [JP] Japan ..... 5-001987

[51] Int. Cl.[6] ..... B21D 5/16

[52] U.S. Cl. ..... 72/307; 72/380; 72/386

[58] Field of Search ..... 72/307, 316, 380, 72/386

[56] References Cited

U.S. PATENT DOCUMENTS

| | | | |
|---|---|---|---|
| 3,395,846 | 8/1968 | Mille | 72/307 |
| 4,367,641 | 1/1983 | Mitzutani | 72/307 |
| 4,555,924 | 12/1985 | Remy et al. | 72/307 |
| 4,747,293 | 5/1988 | Yagi et al. | 72/307 |
| 5,136,871 | 8/1992 | Lisec | 72/307 |
| 5,259,231 | 11/1993 | Kutschker | 72/307 |

FOREIGN PATENT DOCUMENTS

| | | | |
|---|---|---|---|
| 2502518 | 10/1982 | France | 72/380 |
| 0309328 | 12/1988 | Japan | 72/307 |

*Primary Examiner*—David Jones
*Attorney, Agent, or Firm*—Oblon, Spivak, McClelland, Maier & Neustadt

[57] ABSTRACT

The present invention relates to an apparatus for bending a sheet die cutting knife to a specified shape, in which a knife is supported by a supporting mechanism and a clamping mechanism in connection with the upper face of the surface plate and bent by a bending mechanism in which the edge portion of the bending die which constitutes the bending mechanism is brought into contact, through vibrations and drive, with the knife side opposite to the direction along which the knife is about to be bent, by alternatively repeating a specified staying time and knife feeding time by the knife feeding mechanism every time such a bending process is carried out. This makes it possible to bend the knife to various shapes by properly changing the operating time of the bending mechanism and the feeding mechanism with a control device.

23 Claims, 13 Drawing Sheets

KNIFE BENDING APPARATUS

BACKGROUND OF THE INVENTION

1. Field of the Invention

The present invention relates to a bending apparatus for bending a knife for working long and thin sheet-like materials (hereinafter merely called "knife"), which is used for die cutting and creasing such sheet-like materials as paper, plastic sheets, corrugated paper, etc to a specified shape by die cut pressing etc.

2. Description of the Prior Art

For example, as shown in FIG. 12, this kind of knife "A" is like a thin band (for example, the thickness is 0.4 mm to 1.0 mm), has a blade edge 1 and is formed so that the section thereof is roughly rectangular. And, during use, the knife "A" is fitted and fixed in a knife insertion groove 3 which has been pierced and consecutively formed on a wooden knife retainer block 2.

The knife insertion groove 3 has been formed in advance to a required shape (shape corresponding to a die cut shape) by, for example, laser beam machining. On the other hand, for the knife "A", the back 6 side thereof is placed along a surface plate, not shown, and at the same time is put and pressed with a set of bending die from both the sides of the knife "A", thereby causing a specified bending portion 5 to be formed.

Hence, in a conventional apparatus used for bending a knife "A" as described above, because the knife "A" springs up or is inclined on the surface plate due to such actions that the knife "A" is put and pressed from both the sides of the knife "A" by a set of die, such a problem as being impossible to obtain an accurate bending angle for the back 6 of the knife "A" occurs.

Furthermore, in the conventional bending apparatus, such a problem as the knife "A" having to be repeatedly put and pressed with the bending die continuously a considerable number of times to conquer a springback phenomenon (resilient rebound) of the knife "A" occurs, thereby preventing any efficient bending process from being carried out.

SUMMARY OF THE INVENTION

Therefore, the present invention has been developed in view of the above situations, and it is an object of the invention to provide a bending apparatus which can very efficiently bend the knife so that an accurate bending angle for the back thereof can be obtained by making the back of the knife run along on a surface plate.

In order to achieve the above object, the first main means employed by the present invention is a bending apparatus for bending a long and thin plate-like knife, which is characterized in comprising a supporting mechanism to slidably support a knife from both its sides in such a state that one end side of the knife in its lengthwise direction is made to run along the upper face of a surface plate, an energy-charging or clamping mechanism to press the knife toward the upper face of the surface plate, a bending mechanism to be placed adjacent to the supporting mechanism with a specified clearance and to repeatedly give a bending force to the knife which is supported by the supporting mechanism, and a feed mechanism to feed the knife from the supporting mechanism every time when a bending process is carried out by the bending mechanism. Furthermore, in order to achieve the above object, the second main means employed by the present invention is a bending apparatus for bending a long and thin plate-like knife, which is characterized in comprising a supporting mechanism to slidably support a knife from both its sides in such a state that one end side of the knife in its lengthwise direction is made to run along the upper face of a surface plate, an energy-charging or clamping mechanism to press the knife toward the upper face of the surface plate, a bending mechanism to be placed adjacent to the supporting mechanism with a specified clearance and to repeatedly give a bending force to the knife which is supported by the supporting mechanism, a feed mechanism to feed the knife from the supporting mechanism every time when a bending process is carried out by the bending mechanism, and a control device to change the bending action amount of the bending mechanism for the knife and/or the feed amount of the knife by the feed mechanism.

Still furthermore, in order to achieve the above object, the third main means employed by the present invention is a bending apparatus for bending a long and thin plate-like knife, which is characterized in comprising a supporting mechanism to slidably support a knife from both its sides in such a state that one end side of the knife in its lengthwise direction is made to run along the upper face of a surface plate, an energy-charging mechanism or clamping to press to the knife toward the upper face of the surface plate, a bending mechanism to be placed adjacent to the supporting mechanism with a specified clearance and to give a bending force to the knife which is supported by the supporting mechanism, a control device to set, to a specified value, a staying time of the above bending mechanism at its operating position for the knife during the time from start of the bending action of the knife to the end thereof by the bending mechanism and to repeatedly make the bending mechanism operate for bending at an adequate interval of time, and a feed mechanism to feed the knife from the supporting mechanism every time when a bending process is carried out by the bending mechanism.

In the first bending apparatus according to the abovementioned composition, a knife is supported by a supporting mechanism and an energy-charge or clamp mechanism, with reference to the upper face of a surface plate. A knife supported as described above is subjected to bending by a bending apparatus. And the knife is feed from the supporting mechanism to a feed mechanism every time the bending is carried out, thereby causing the knife to be bent to a specified radius.

With these procedures, elongation of a knife material in line with the elastic deformation in the bending process can be preferably absorbed at the bending portion, and the knife is bent to an accurate bending angle without shearing, with reference to the upper face of the surface plate.

In the second bending apparatus according to the abovementioned composition, a knife is supported by a supporting mechanism-and an energy-charge or clamp mechanism, with reference to the upper face of a surface plate. A knife supported as described above is subjected to bending by a bending apparatus. And the knife is fed from the supporting mechanism to a feed mechanism every time when the bending is carried out, thereby causing the knife to be bent to a specified radius.

With these procedures, elongation of a knife material in line with the elastic deformation in the bending process can be preferably absorbed at the bending portion, and the knife is bent to an accurate bending angle without shearing, with reference to the upper face of the surface plate.

Furthermore, in the bending apparatus according to the abovementioned composition, since it is possible to properly change the bending action amount of the bending mechanism for the knife and the feed amount of the knife by the feed mechanism, the springback phenomenon for the knife can be preferably suppressed, and it is possible to remarkably efficiently carry out bending processes to a specified shape.

Namely, in the apparatus, the knife back is made to run along on the surface plate, the springback phenomenon is preferably suppressed so that an accurate bending angle for the back can be obtained, and it is possible to very efficiently work or bend the knife.

Still furthermore, it is possible to mold the knife in various kinds of shapes by properly changing the action amounts of the bending mechanism and feed mechanism by means of a control device.

Still additionally, in the third bending apparatus according to the abovementioned composition, as the bending mechanism can stay at the position, where the bending mechanism operates on the knife, for a specified period of time, roughly as well as in the first and second bending apparatuses, the springback phenomenon for the knife can be preferably suppressed, and the bending process is remarkably efficient.

DETAILED DESCRIPTION OF THE PREFERRED EMBODIMENTS

Figure 1:
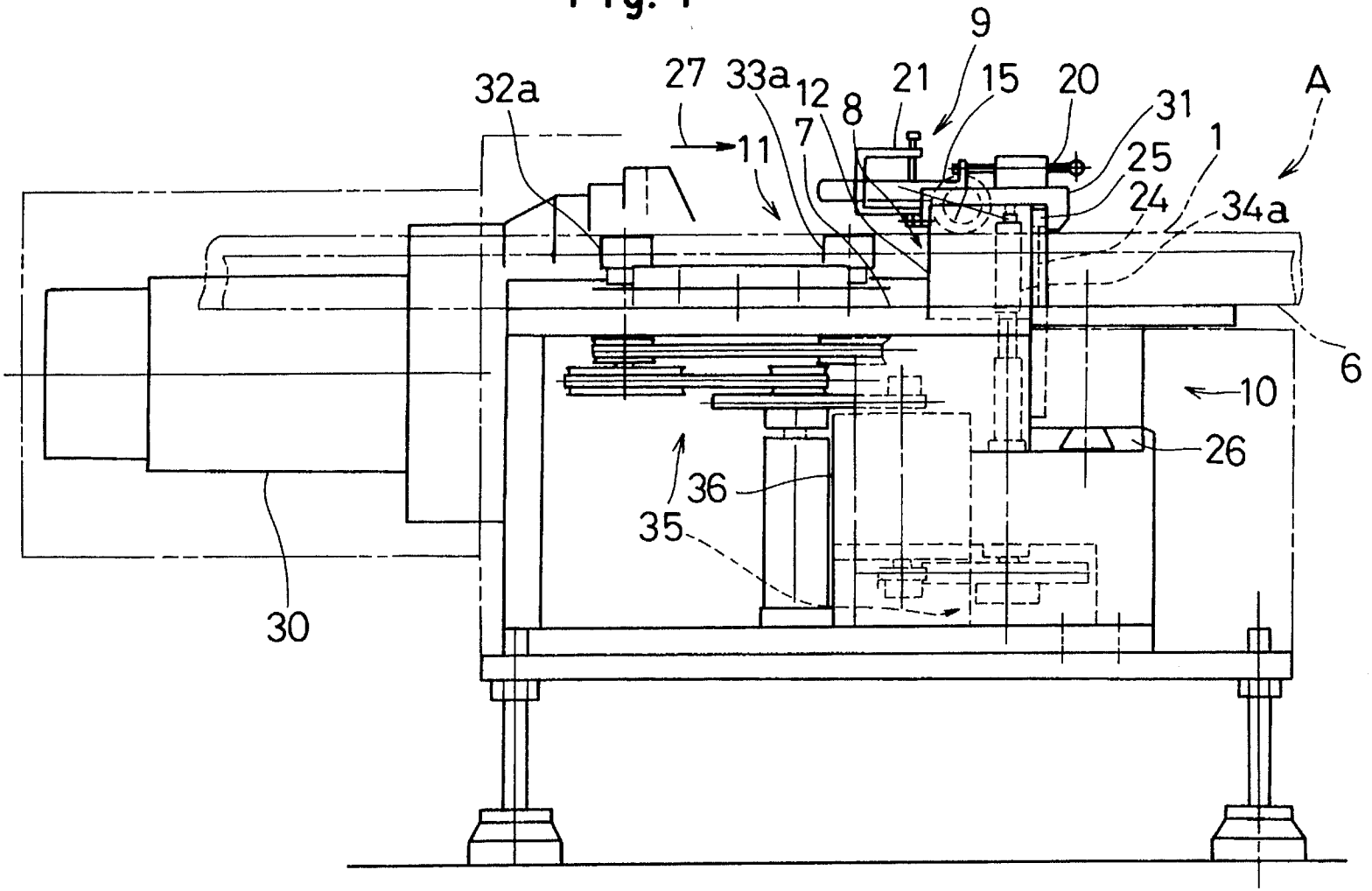
FIG. 1 is a side view of a bending apparatus according to a preferred embodiment of the present invention.
Figure 2:
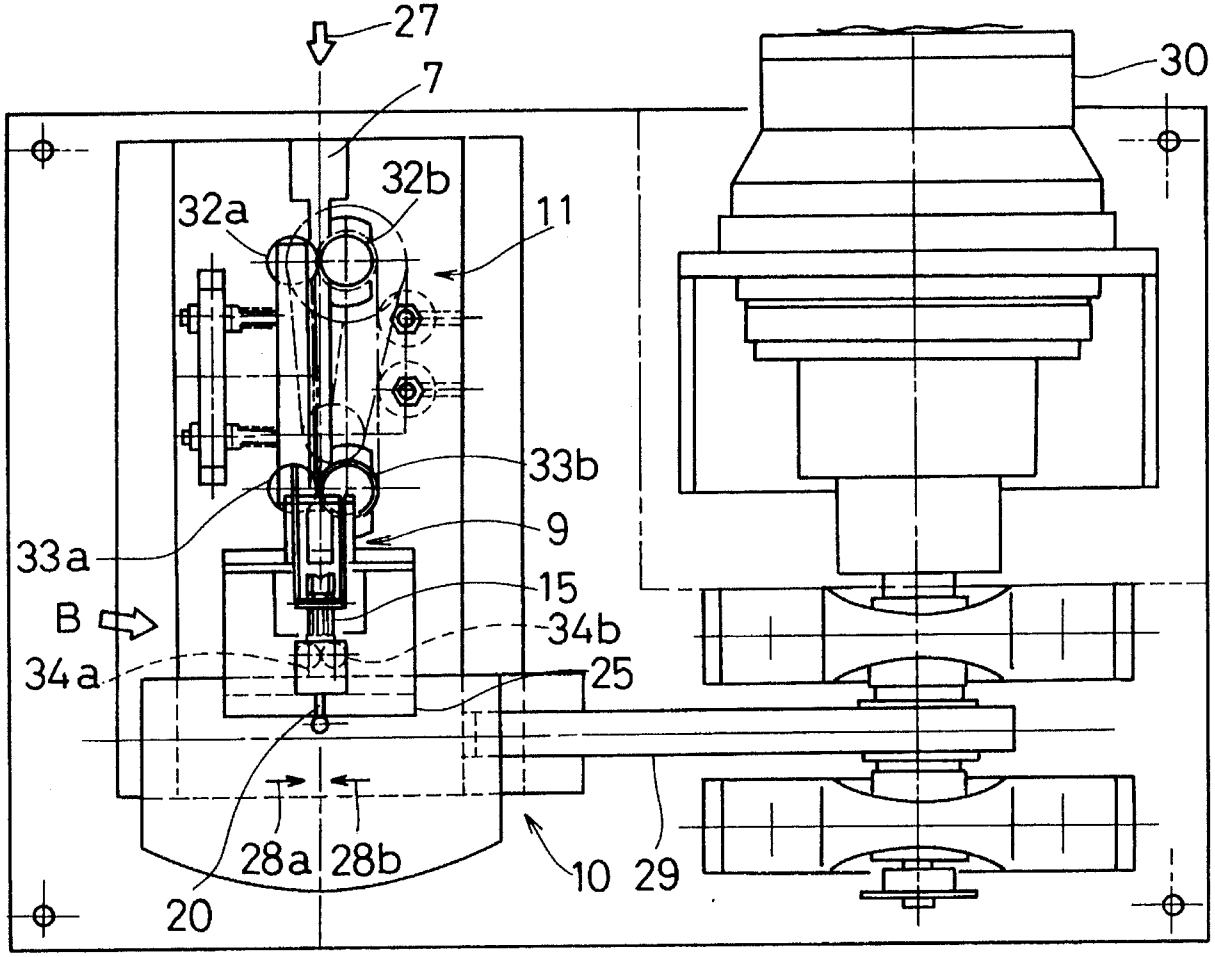
FIG. 2 is a plan view of the bending apparatus.
Figure 3:
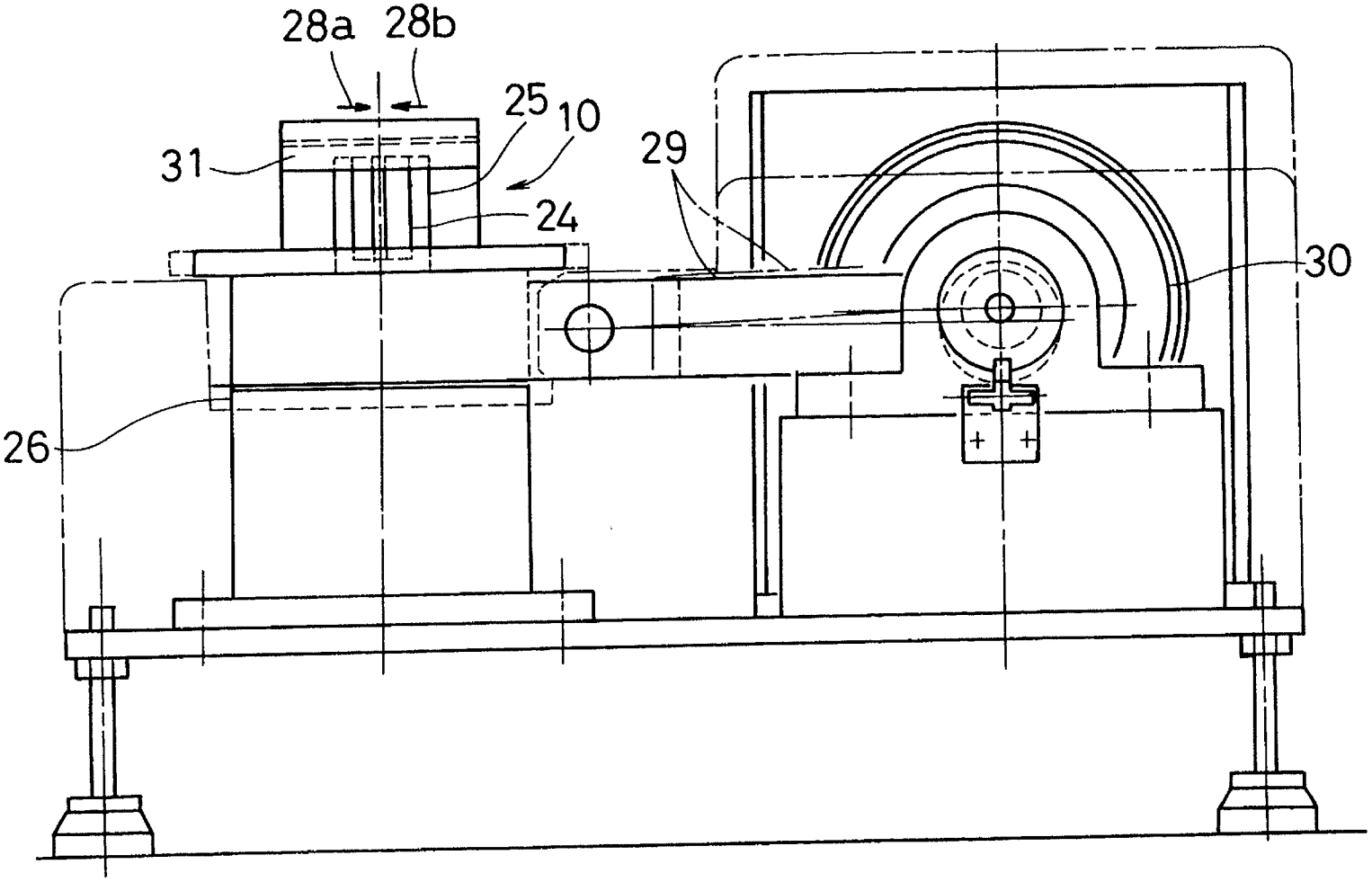
FIG. 3 is a front view of the bending apparatus.
Figure 4:
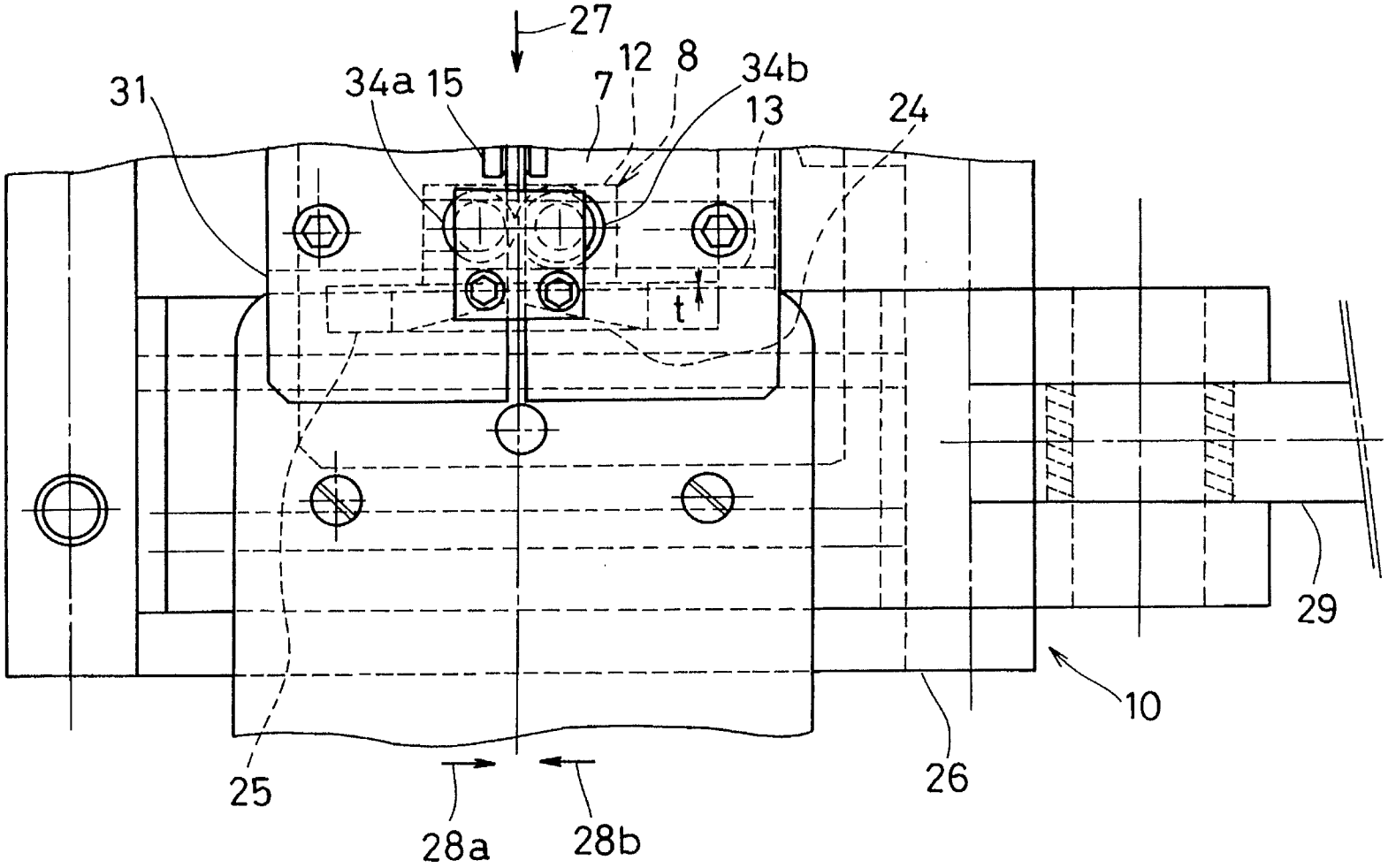
FIG. 4 is an enlarged view of the portion shown with the arrow B of FIG. 2.

With reference to the drawings attached herewith, a preferred embodiment in which the present invention is embodied will be described for a better understanding of the invention. The following preferred embodiment is only one of the examples in which the present invention is embodied and is not of such a nature that it limits the technical scope of the invention.

As shown in FIGS. 1 to 4 and 13, a bending apparatus in accordance with the preferred embodiment comprises a supporting mechanism 8 to slidably support a knife "A" from both its sides in such a state that the back 6 (one end side in its lengthwise direction) of the knife "A" is made to run along the upper face of a surface plate 7, an energy-charging mechanism or clamp 9 presses the knife "A" toward the upper face of the surface plate 7, a bending mechanism 10 to be placed adjacent to the supporting mechanism 8 with a specified clearance "t" (See FIG. 4) and to repeatedly give a bending force to the knife "A" which is supported by the supporting mechanism 8, a feed mechanism 11 to feed the knife "A" from the supporting mechanism 8 every time when bending process is carried out by the bending mechanism 10, and a control device 39 to change the bending action amount of a bending die 24 of the bending mechanism 10 for the knife "A" and/or the feed amount of the knife "A" by the feed mechanism 11.

The supporting mechanism 8 is provided with a block 12 in which a through hole groove to penetrate the knife "A" is inscribed, and the clearance "t" between a spacer 13 attached to the front face of the block 12 and the bending mechanism 10 can be adjusted by properly changing the spacer 13.

Figure 8:
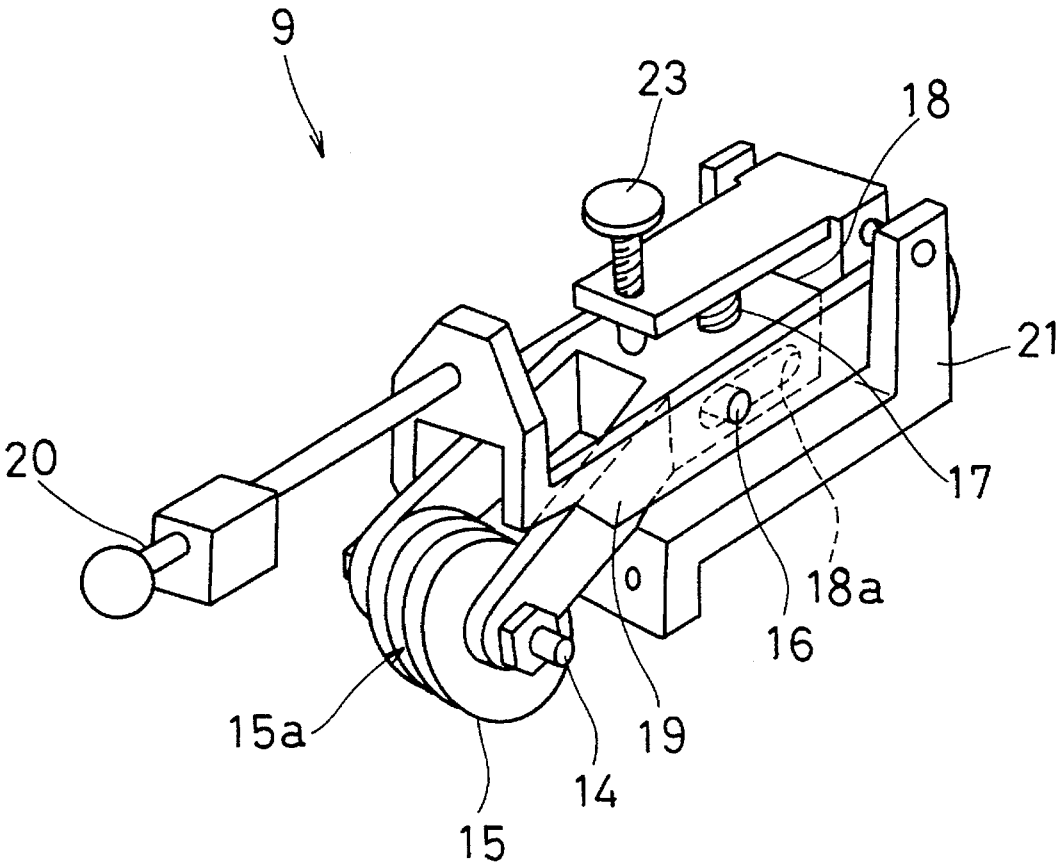
FIG. 8 is a perspective view of a press roller device which constitutes the bending apparatus.
Figure 9A:
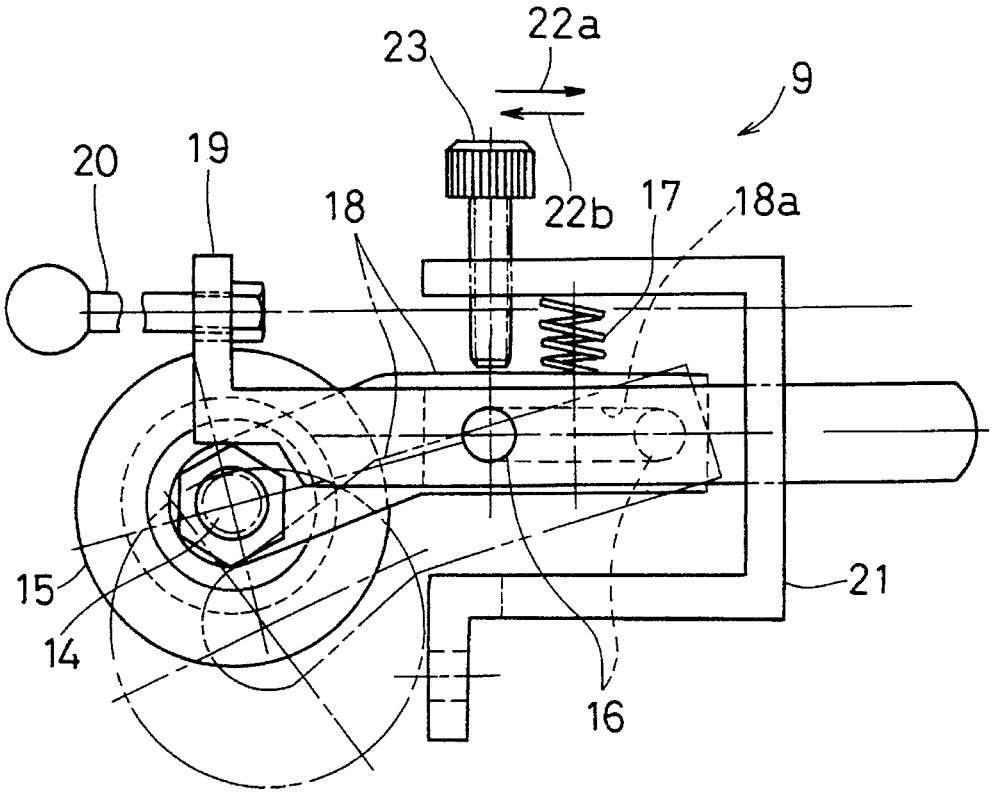
FIG. 9A is a side view showing the detailed structure of the press roller device.
Figure 9B:
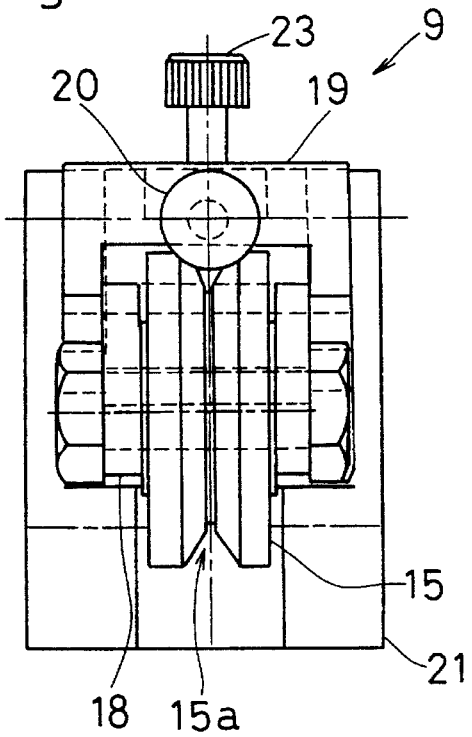
FIG. 9B is a front view thereof.

As shown in FIGS. 8 and 9, the clamp mechanism 9 is arrayed opposite to the upper face of the surface plate 7 and consists of a press roller device which presses the knife "A" onto the upper face of the surface plate 7.

In the press roller device is endlessly inscribed a supporting groove 15*a* to fit and insert the blade edge 1 of the knife "A" to the circumferential face of a roller 15 which is rotatably supported by a shaft 14 and to support the tapered face thereof. And the shaft 15 is rockably supported by a supporting shaft 16 against the upper face of the surface plate 7, and at the same time is elastically energy-charged toward the upper face by a spring 17 which is an example of an energy-charging means.

Namely, a long slit 18*a* is pierced and formed in the lengthwise direction of a bracket 18 which supports the roller 15, and the support shaft 16 attached to a bracket 19 is slidably inserted into the long slit 18*a*. The bracket 19 is provided with an operating lever 20, and the bracket 19 is slidably supported with a bracket 21 attached to the bending apparatus body in the same direction as the lengthwise direction of the long slit 18*a* of the bracket 18.

Subsequently, the spring 17 intervenes between the position corresponding to the intermediate portion pertaining to the lengthwise direction of the long slit 18*a* on the bracket 18 and the bracket 21.

Therefore, in the case that an operator grasps the operating lever 20 and operates it, for example, in the direction of the arrow 22*a* in the press roller device according to the above construction, the supporting shaft 16 moves to the position shown with a broken line in FIG. 9A, and the roller 15 is energy-charged toward the upper face of the surface plate 7 with an elastic energy charged in the spring 17. On the other hand, in the case that the bracket 19 is made to move in the direction of the arrow 22*b* by operating the lever 20, the supporting shaft 16 will move to the position shown with a solid line in the same FIG., and the roller 15 will be rockably energy-charged upwards by an action of the spring 17. Also, in this case, the rocking position is regulated by a stopper 23.

That is, the press roller device relatively varies the position of the supporting shaft 16 relative to the position energy-charged by the spring 17, thereby causing the energy-charging direction of the roller 15 in connection with the upper face of the surface plate 7 to be properly selectively changed.

Therefore, in the press roller device, it is possible to press the knife "A" onto the surface plate 7 without damaging the blade edge 1 of the knife "A" and to retain it without fail, and at the same time the press roller device can properly correspond to changes in the height of the knife "A". Furthermore, it is very easy to change the retaining state and the releasing state relative to the knife "A" only by simply operating the lever 20 in the forward and backward direction.

The bending apparatus 10 is composed of the bending die 24 (See FIG. 5A) for bending the knife "A" through operating on the side of the knife "A".

Figure 5A:
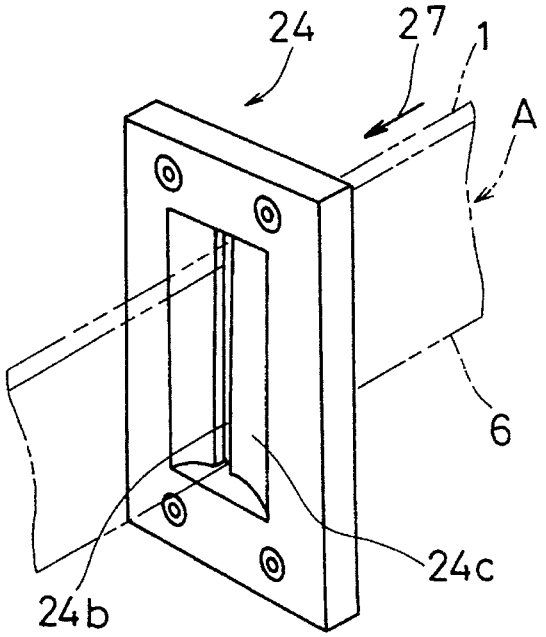
FIG. 5A is a perspective view showing a knife bending die, which constitutes the bending apparatus.
Figure 5B:
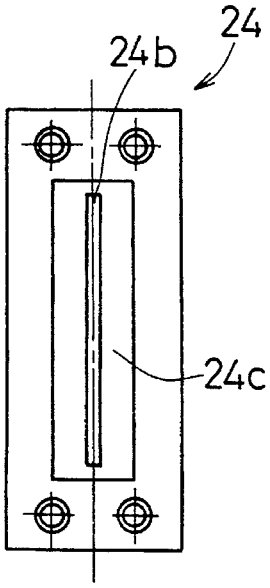
FIG. 5B is a front view thereof.
Figure 5C:
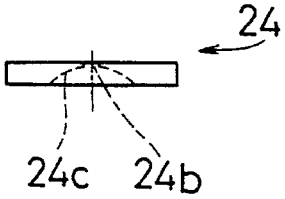
FIG. 5C is a plan view thereof.
Figure 5D:
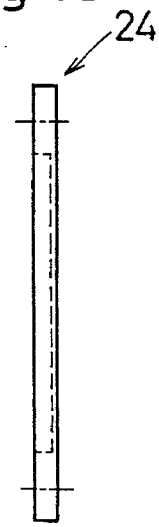
FIG. 5D is a side view thereof.
Figure 5E:
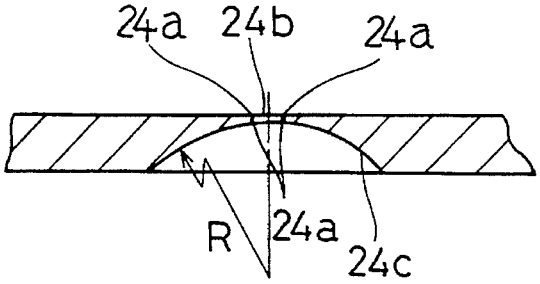
FIG. 5E is an enlarged cross sectional view of essential parts of FIG. 5C.

The bending die 24 is integrally composed of a thin plate-like member as illustrated in FIGS. 5A & 5E, and roughly at the middle portion thereof, a hollow groove 24*b* provided with an edge portion 24*a* (FIG. 5E), which will become parallel to both the sides of the knife "A" when the knife "A" passes therethrough with a proper clearance, is integrally formed by, for example, a wire cutting process. And the edge portions 24*a*, 24*a* are hardened. In this case, the abovementioned proper clearance is of such a dimension that one edge portion 24*a* can be brought into contact with either side (the side opposite to the direction along which the knife "A" is about to be bent) of the knife "A" when the bending die 24 is vibrated as described later. Namely, it is of such a dimension that both the edge portions 24*a* are not brought into contact with both the side portions of the knife "A" in line with the vibrations of the bending die 24.

An arcuate circumferential face 24*c* consisting of a curvature radius R (FIG. 5E) is inscribed at the front side of the bending die 24 for the purpose of easy transit of the knife "A" after it has been bent.

The bending die 24 composed as stated above is removably fitted in a base 25 (See FIG. 6A–6C) equivalent to a holder and is retained with screws at its upper and lower parts. At the base 25, the lower end portion thereof is slidably supported by a slide bearing 26, linearly as illustrated, in the right angle direction (the direction of the arrows 28*a* and 28*b*) relative to the send-out direction (the direction of the arrow 27) of the knife "A".

Then, the base 25 is vibrated and driven, along with the bending die 24, in the bending direction of the knife "A" by a motor 30 which is controlled through a crank 29 by the control device 39.

Also, in this case, in order to obtain the rectangularity by preventing the inclination ( the inclination in the direction of the arrow 27 of the upper part of the bending die 24 ) of the bending die 24 in connection with the upper face of the surface plate 7, the upper part of the base 25 is supported at the L-shaped end of a supporting member 31 which is formed to be roughly L-shaped. In this case, the base 25 is slidable in the right and the left directions (the directions of the arrows 28*a* and 28*b*) relative to the supporting member 31.

At the bending die 24 composed as stated above, as the hollow groove 24*b* is integrally formed as described above, the parallelism of the edge portions 24*a*, 24*a* relative to the side of the knife "A" can be secured, and a bending process can be carried out, with accurate rectangularity obtained, without such an inconvenience as a warping caused to be present in the knife "A". Besides, because the bending die 24 is formed to be thin as stated above, it is possible to carry out bending processes of comparatively small curvature radius for the knife "A".

Figure 10:
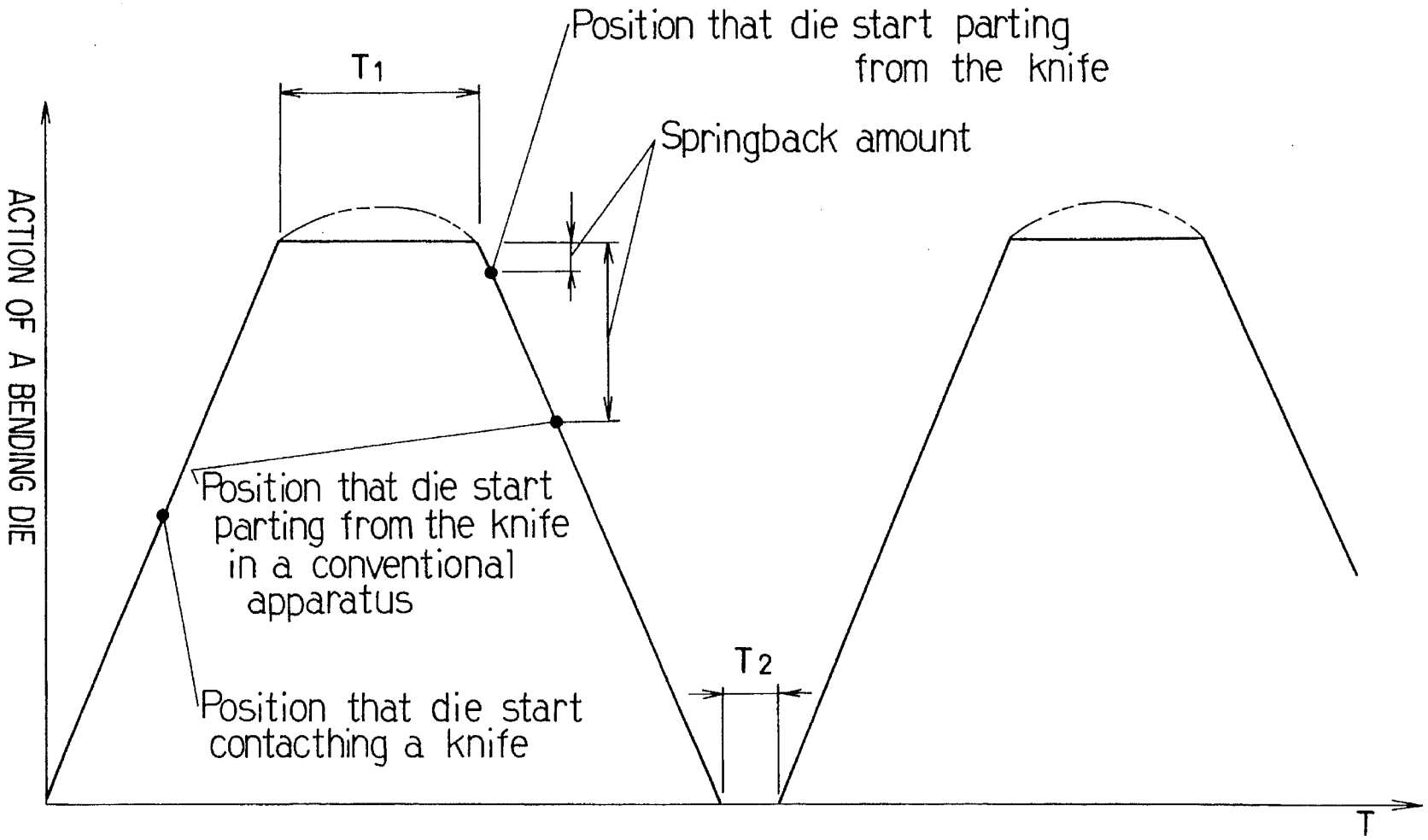
FIG. 10 is a graph showing the actions of the bending die to be used when bending a knife by the bending apparatus.

Furthermore, as shown in FIG. 10, as the bending die 24 is controlled by a control device 39 so that it can stay, for a specified pressing time (the period of staying time: the period of stopping time in such a state that the bending die 24 is in contact with the side of the knife "A") $T_1$, at the position operating on the knife "A", the springback amount on the knife "A" will be epochmakingly decreased more than any conventional apparatus, thereby causing a remarkably efficient bending process to be carried out. That is, the number of times of bringing the bending die 24 into contact with the side of the knife "A" can be much decreased.

In this case, when it is assumed that, for example, the material of the knife "A is a general blade material and its thickness is 0.7 mm to 1.0 mm, it is preferable that the staying time $T_1$ is about 0.3 to 0.4 seconds.

Figure 11A:
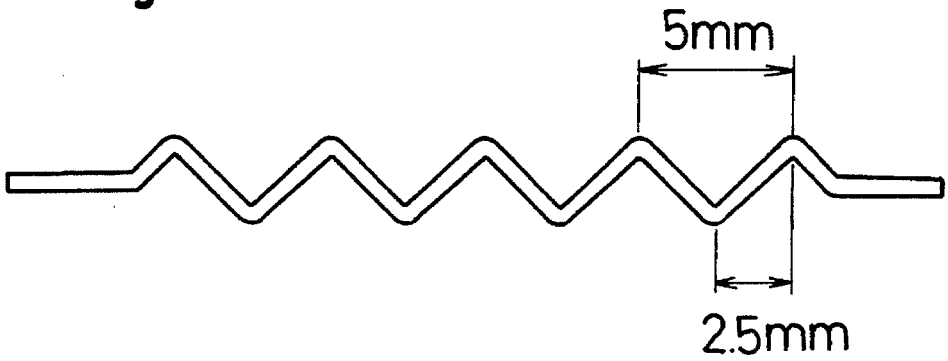
FIG. 11A, 11B and 11C are plan views of the knife which has been bent by the bending apparatus.
Figure 11B:
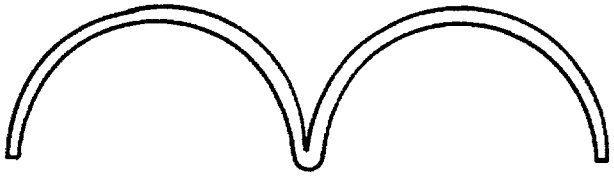
Figure 11C:
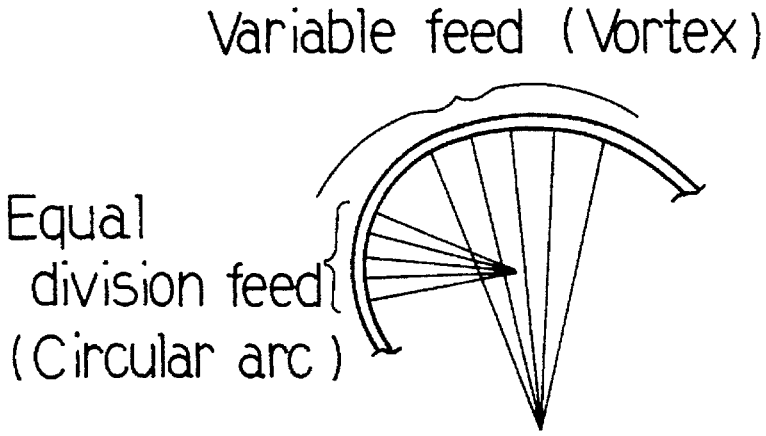
Figure 12:
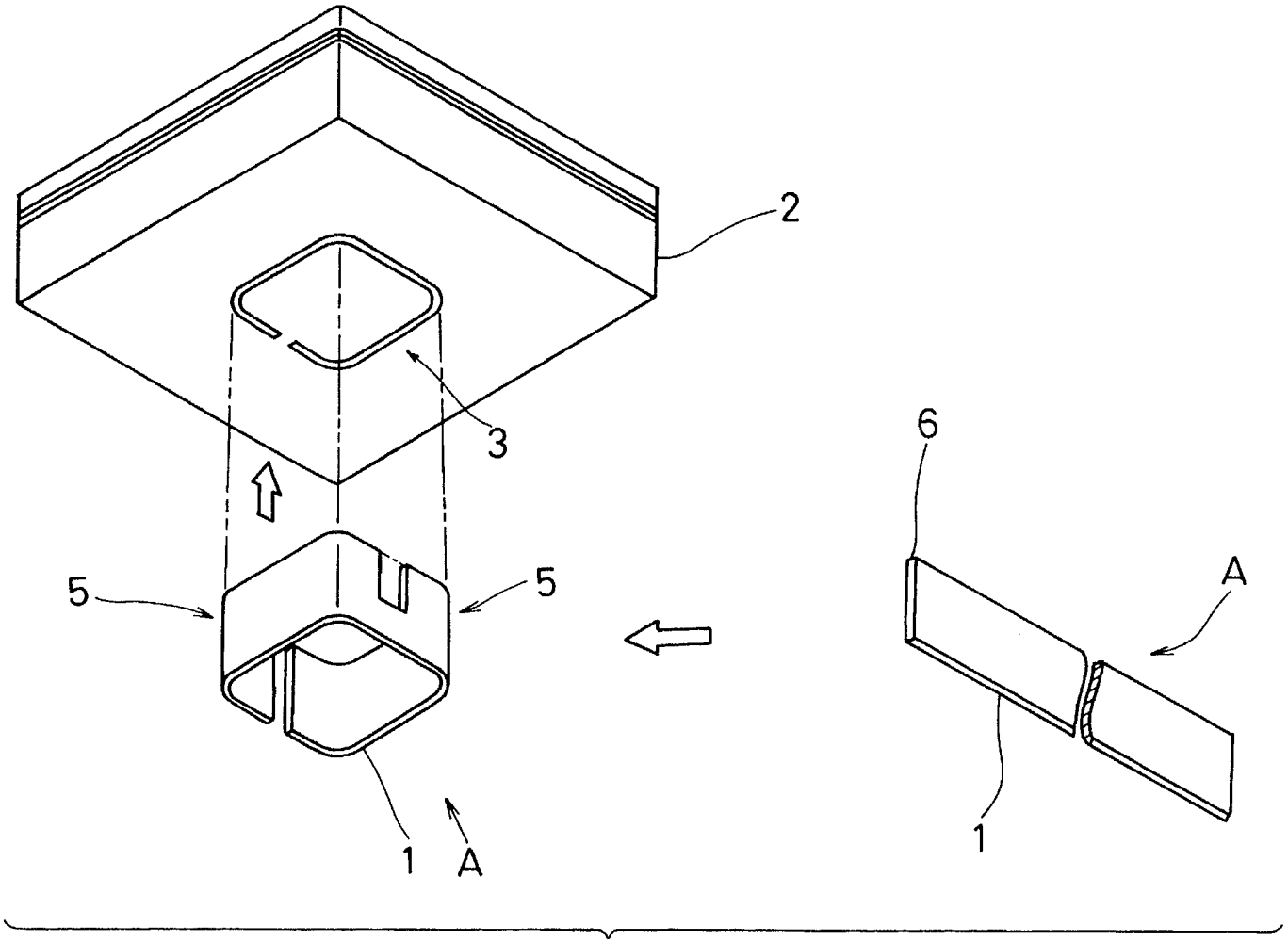
Fig.12 (PRIOR ART)
FIG. 12 is a perspective view of the knife retainer block before a knife is installed on the knife retainer block, for the purpose of explaining the background art of the present invention.
Figure 13:
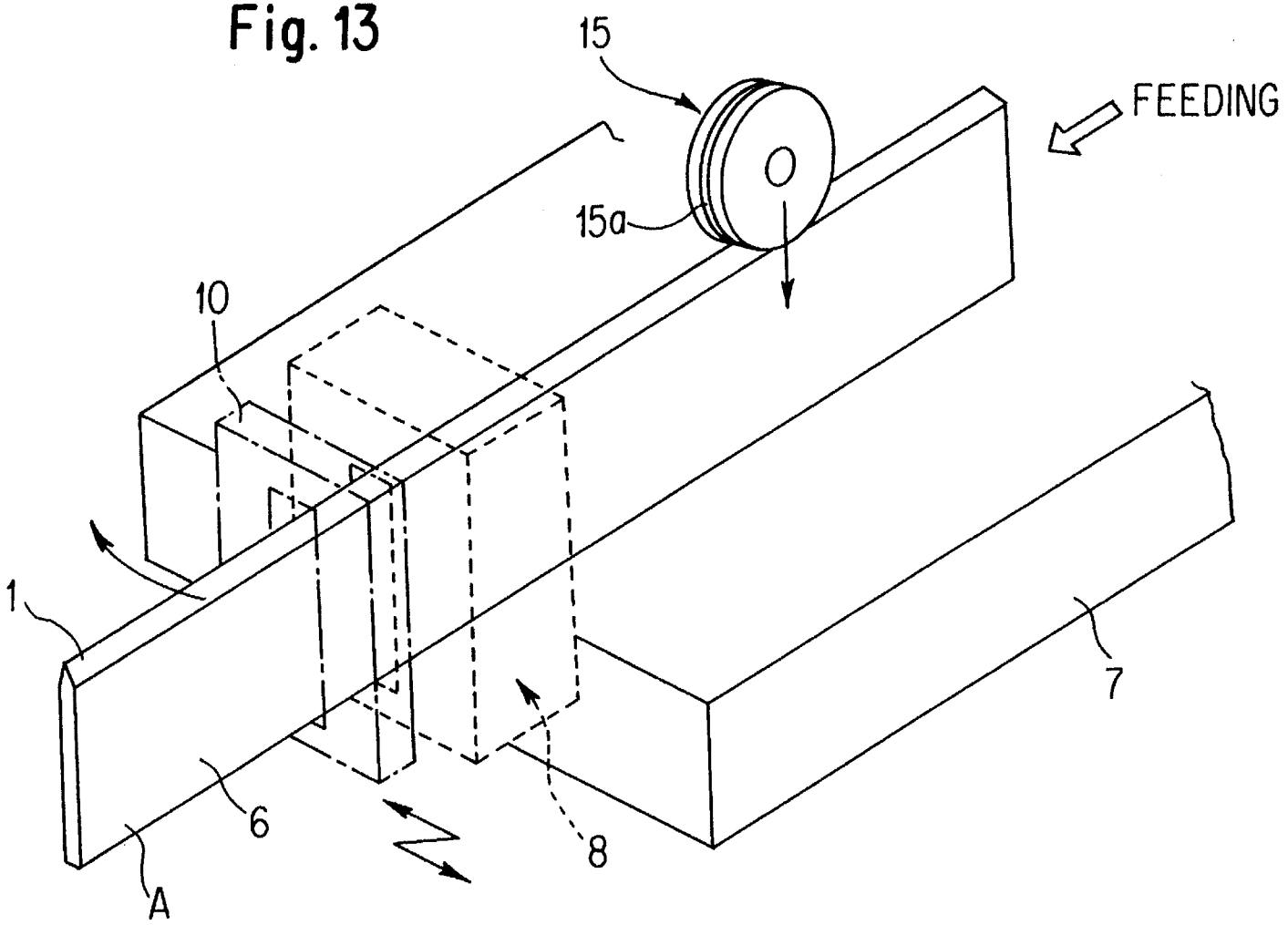
FIG. 13 is a perspective view of the bending apparatus of the present invention.

Besides, in the bending apparatus, the control device 39 is concurrently provided with a function to change the bending action amount relative to the knife "A" in the vibration actions of the bending die 24 and the feed amount of the knife "A" by the feed mechanism 11, for example, whenever carrying out bending processes. Therefore, in the apparatus, it is possible to work the knife "A" to various shapes, for example, bellows, arcuate or spiral shape, etc. (See FIG. 11A, 11B and 11C).

Below will be described one of the examples of the control thereof.

For example, in the case that a bending process is performed on the knife "A" so that the curvature radius becomes, for example, 5 mm, while it is assumed that the feed amount of the knife "A" by the send-out mechanism 11 is variable in the range from 0.3 to 2 mm, the bending die 24 is actuated at a constant bending action amount as the knife "A" is fed repeatedly three to five times by a pitch of 0.5 mm at every bending process. It is thereby possible to simply bend the knife "A" to a circular arc shape of small radius with high accuracy. Still furthermore, in this case, the knife "A" can be formed to be like a vortex in its plan view by gradually increasing the feed amount by the feed mechanism 11. Simultaneously, the bending amount of the bending die 24 may be gradually changed.

Furthermore, in the case that the knife "A" is bent by 90° in its plan view, the knife "A" is bent by 45° by the bending die 24 in the first bending process.

Thereafter, the knife "A" is sent out by 0.5 mm by the feed mechanism 11, and it is further bent by 45° by the bending die 24. Then, the knife "A" is thereby bent by almost 90° visually.

Figure 6A:
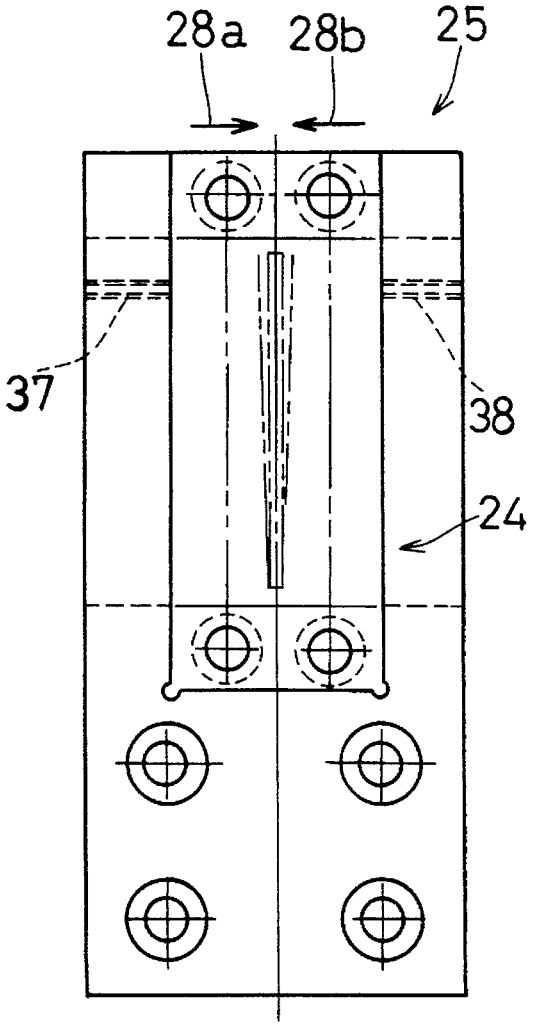
FIG. 6A is a front view showing a base to retain the bending die.
Figure 6B:
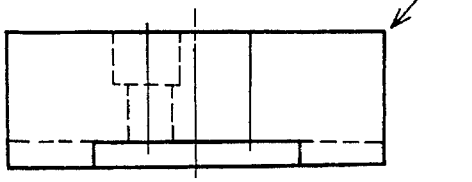
FIG. 6B is a plan view thereof.
Figure 6C:
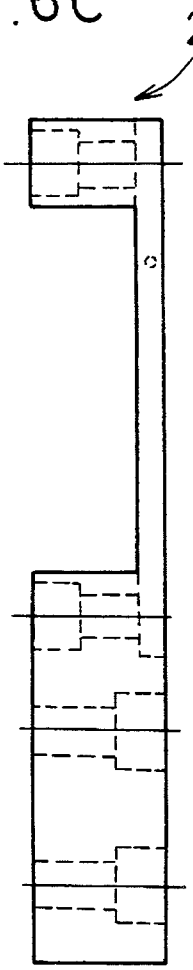
FIG. 6C is a side view thereof.

Hereupon, as shown in FIG. 6A, the base 25 according to the preferred embodiment is provided at the upper part of the retaining position of the bending die 24, with screws 37 and 38 for micro adjustment of the inclination degree (the inclination angle in the directions of the arrows 28*a*, 28*b* in connection with the upper face of the surface plate 7) of the bending die 24 in its right and left directions. The screws 37, 38 are properly adjusted to incline the bending die 24 relative to the surface plate 7. In the case that the knife "A"

is bent under this condition, the knife "A" is given a distributary force in the direction along which it is pressed down toward the upper face of the surface plate 7. As a result, it is possible to carry out bending in such a state that the knife "A" back 6 is always applied to the upper face of the surface plate 7.

Figure 7A:
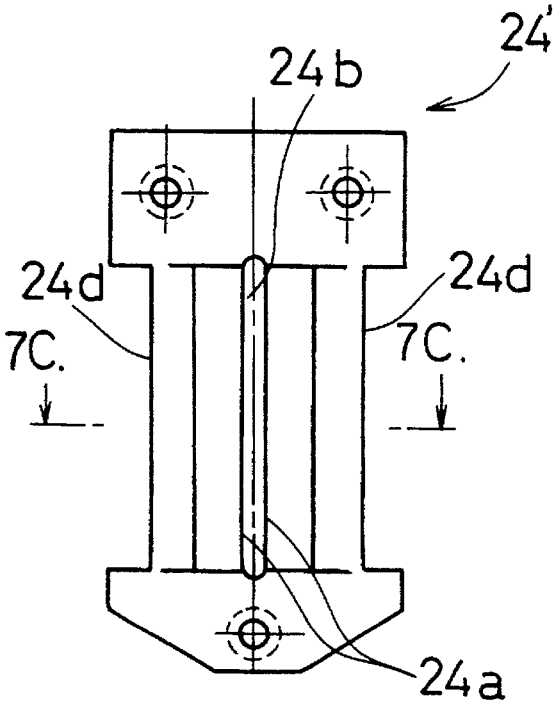
FIG. 7A is a front view showing the knife bending die according to another preferred embodiment.
Figure 7B:
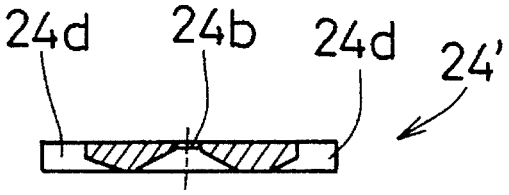
FIG. 7B is a cross sectional view taken at the line marked with the arrows C–C' in FIG. 7A.
Figure 7C:
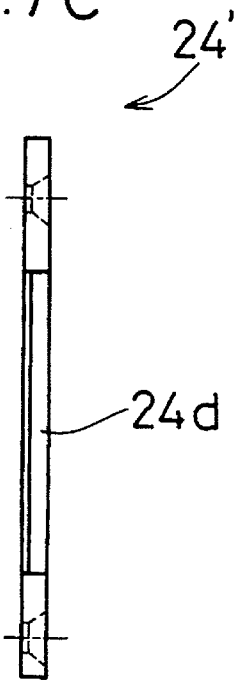
FIG. 7C is a side view thereof.

FIG. 7A–7C show a bending die 24' according to another preferred embodiment.

In the bending die 24', notches **24*d*, 24*d* are formed at both sides of the edge part 24*a*, putting it therebetween. Thus, by providing a notch 24*d* like this, it is possible to insert and pass the edge part of the knife "A" which has been bent, into the notch 24*d***, thereby causing the knife "A" to be repeatedly bent.

The feed mechanism 11 is provided with a plurality of rollers **32*a*, 32*b*, 33*a*, 33*b*, 34*a*, 34*b* so that the knife "A" is held from both its sides and is sent out in the direction of the arrow 27. Each of these rollers are driven synchronously with a motor 36 through an interlocking mechanism 35 consisting of a plurality of belts, pulleys, etc. Their rollers 32*b*, 33*b* properly correspond to the thickness of the knife "A" and are supported so that their position relative to the knife "A" can be changed, thereby causing the rollers 32*b*, 33*b* to be elastically energy-charged in the direction of the arrow 28*b*** at all times.

The motor 36 is controlled synchronously with the motor 30.

In the bending apparatus composed as described above, a knife "A" is retained by the supporting mechanism 8 and the clamp mechanism 9, with reference to the upper face of the surface plate 7. The knife "A" which is retained as shown above will be bent by the bending mechanism 10.

Namely, the base 25 is vibrated and driven by the motor 30 so that one edge portion **24*a* of the hollow groove 24*b* of a bending die 24 comes in contact with the knife side opposite to the direction along which the knife "A" is about to be bent. In this case, as the edge part 24*a* whose parallelism is secured relative to the knife "A" side is vibrated and driven linearly, repeating a specified staying time $T_1$ and knife "A" sending time $T_2$ by turns, with the edge part 24*a* vertically stood in connection with the surface plate 7**, the knife "A" will be bent with an accurate rectangularity obtained.

Thus, every time when the bending process is carried out, the knife "A" is sent out from the supporting mechanism 8 by the send-out mechanism 11 and is bent to a specified curvature radius.

With these procedures, elongation of the knife material in line with the elastic deformation in bending can be preferably absorbed at the bending portion thereof, and at the same time its springback can be suppressed. More over, the knife "A" is very efficiently bent to an accurate angle, with reference to the upper face of the surface plate 7, without any shearing.

Furthermore, in this case, it is possible to bend and form the knife "A" in various shapes in its plan view by properly controlling the bending action amount of the bending die 24 and the feed amount of the knife "A" by the feed mechanism 11 by the control device 39.

Hereupon, in the bending apparatus according to the above construction, in the case that the clearance "t" formed between the block 12 which constitutes the supporting mechanism 8 and the bending die 24 which constitutes the bending mechanism 10 is made zero, the knife "A" can be sheared with an accurate rectangularity at a specified dimension.

What is claimed is:

1. A knife bending apparatus for bending a long and thin plate-like knife having two lateral sides, a blade edge and a back end opposite said blade edge, the apparatus comprising;

a supporting mechanism for slidably supporting said knife at said two lateral sides thereof, a surface plate located adjacent the supporting mechanism, said supporting mechanism holding the blade in such a state that said back end of the knife in a lengthwise direction of the knife thereof is made to run along a top surface of said surface plate;

a bending mechanism, which is placed next to, and a required distance from the supporting mechanism, for repeatedly giving a bending force to the knife supported by the supporting mechanism by a bending die which selectively presses the knife from either side thereof so as to selectively bend the blade in opposite directions; and a feeding mechanism for feeding the knife from the supporting mechanism whenever a bending process is carried out by the bending mechanism.

2. A knife bending apparatus as set forth in claim 1, wherein the bending die which constitutes the bending mechanism is integrally composed of a plate-like member and is further integrally formed to have a hollow groove having edge portions which are made parallel to the both sides of the knife when the knife is caused to pass therethrough roughly at a middle portion thereof with a proper clearance.

3. A knife bending apparatus as set forth in claim 2, wherein the bending die is composed so that a side of one end of the bending die is linked with a drive mechanism which reciprocates in a right angle direction relative to the side portion of the knife, and the other end side thereof is supported by a supporting means which prevents an inclination toward the right angle direction relative to a travelling direction by the drive mechanism.

4. A knife bending apparatus for bending a long and thin plate-like knife having two lateral sides, a blade edge and a back end opposite said blade edge, the apparatus comprising:

a supporting mechanism for slidably supporting said knife at said two lateral sides thereof, a surface plate located adjacent the supporting mechanism, said supporting mechanism holding the blade in such a state that said back end of the knife in a lengthwise direction of the knife thereof is made to run along a top surface of said surface plate;

a clamping mechanism, located opposite said surface plate of said supporting mechanism, with a press roller having a groove to fit and insert said blade edge of the knife, said clamping mechanism clamping the blade between the roller and the top surface of the surface plate;

a bending mechanism, which is placed next to, and a required distance from the supporting mechanism, for repeatedly giving a bending force to the knife supported by the supporting mechanism by a bending die which selectively presses the knife from either side thereof so as to selectively bend the blade in opposite directions; and a feeding mechanism for feeding the knife from the supporting mechanism whenever a bending process is carried out by the bending mechanism.

5. A knife bending apparatus as set forth in claim 4, wherein a supporting position by a supporting shaft which supports the press roller is relatively variable with respect to a clamping position by the clamping mechanism, and a clamping direction of the press roller relative to the top surface of the surface plate is properly selectively changed.

6. A knife bending apparatus as set forth in claim 4, wherein the bending die which constitutes the bending mechanism is integrally composed of a plate-like member and is further integrally formed to have a hollow groove having edge portions which are made parallel to the both sides of the knife when the knife is caused to pass therethrough roughly at a middle portion thereof with a proper clearance.

7. A knife bending apparatus as set forth in claim 6, wherein the bending die is composed so that a side of one end of the bending die is linked with a drive mechanism which reciprocates in a right angle direction relative to the side portion of the knife, and the other end side thereof is supported by a supporting means which prevents an inclination toward the right angle direction relative to a travelling direction by the drive mechanism.

8. A knife bending apparatus for bending a long and thin plate-like knife having two lateral sides, a blade edge and a back end opposite said blade edge, the apparatus comprising:

a supporting mechanism for slidably supporting said knife at said two lateral sides thereof, a surface plate located adjacent the supporting mechanism, said supporting mechanism holding the blade in such a state that said back end of the knife in a lengthwise direction of the knife thereof is made to run along a top surface of said surface plate;

a clamping mechanism, located opposite said surface plate of said supporting mechanism, with a press roller having a groove to fit and insert said blade edge of said knife, said clamping mechanism clamping the blade between the roller and the top surface of the surface plate;

a bending mechanism, which is placed next to, and a required distance from the supporting mechanism, for repeatedly giving a bending force to the knife supported by the supporting mechanism by a bending die which selectively presses the knife from either side thereof so as to selectively bend the blade in opposite directions;

a feeding mechanism for feeding the knife from the supporting mechanism whenever a bending process is carried out by the bending mechanism; and a device for controlling and changing an amount of movement of the bending die.

9. A knife bending apparatus as set forth in claim 8, wherein a supporting position by a supporting shaft which supports the press roller is relatively variable with respect to a clamping position by the clamping mechanism, and a clamping direction of the press roller relative to the top surface of the surface plate is properly selectively changed.

10. A knife bending apparatus as set forth in claim 8, wherein the bending die which constitutes the bending mechanism is integrally composed of a plate-like member and is further integrally formed to have a hollow groove having edge portions which are made parallel to the both sides of the knife when the knife is caused to pass therethrough roughly at a middle portion thereof with a proper clearance.

11. A knife bending apparatus as set forth in claim 10, wherein the bending die is composed so that a side of one end of the bending die is linked with a drive mechanism which reciprocates in a right angle direction relative to the side portion of the knife, and the other end side thereof is supported by a supporting means which prevents an inclination toward the right angle direction relative to a travelling direction by the drive mechanism.

12. A knife bending apparatus for bending a long and thin plate-like knife having two lateral sides, a blade edge and a back end opposite said blade edge, the apparatus comprising:

a supporting mechanism for slidably supporting said knife at said two lateral sides thereof, a surface plate located adjacent the supporting mechanism, said supporting mechanism holding the blade in such a state that said back end of the knife in a lengthwise direction of the knife thereof is made to run along a top surface of said surface plate;

a clamping mechanism, located opposite said surface plate of said supporting mechanism, with a press roller having a groove to fit and insert said blade edge of the knife, said clamping mechanism clamping the blade between the roller and the top surface of the surface plate;

a bending mechanism, which is placed next to, and a required distance from the supporting mechanism, for repeatedly giving a bending force to the knife supported by the supporting mechanism by a bending die which selectively presses the knife from either side thereof so as to selectively bend the blade in opposite directions;

a feeding mechanism for feeding the knife from the supporting mechanism whenever a bending process is carried out by the bending mechanism; and a device for controlling and changing an amount of feeding of the knife by the feeding mechanism.

13. A knife bending apparatus as set forth in claim 12, wherein a supporting position by a supporting shaft which supports the press roller is relatively variable with respect to a clamping position by the Clamping mechanism, and the clamping direction of the press roller relative to the top surface of the surface plate is properly selectively changed.

14. A knife bending apparatus as set forth in claim 12, wherein the bending die which constitutes the bending mechanism is integrally composed of a plate-like member and is further integrally formed to have a hollow groove having edge portions which are made parallel to the both sides of the knife when the knife is caused to pass therethrough roughly at a middle portion thereof with a proper clearance.

15. A knife bending apparatus as set forth in claim 14, wherein the bending die is composed so that a side of one end of the bending die is linked with a drive mechanism which reciprocates in a right angle direction relative to the side portion of the knife, and the other end side thereof is supported by a supporting means which prevents an inclination toward the right angle direction relative to a travelling direction by the drive mechanism.

16. A knife bending apparatus for bending a long and thin plate-like knife having two lateral sides, a blade edge and a back end opposite said blade edge, the apparatus comprising:

a supporting mechanism for slidably supporting said knife at said two lateral sides thereof, a surface plate located adjacent the supporting mechanism, said supporting mechanism holding the blade in such a state that said back end of the knife in a lengthwise direction of the knife thereof is made to run along a top surface of said surface plate;

a clamping mechanism located opposite said surface plate of said supporting mechanism, with a press roller having a groove to fit and insert the blade edge of the knife, said clamping mechanism clamping the blade between the roller and the top surface of the surface plate;

a bending mechanism, which is placed next to, and a required distance from the supporting mechanism, for repeatedly giving a bending force to the knife supported by the supporting mechanism by a bending die which selectively presses the knife from either side thereof so as to selectively bend the blade in opposite directions;

a feeding mechanism for feeding the knife from the supporting mechanism whenever a bending process is carried out by the bending mechanism; and a device for controlling and changing an amount of movement of the bending die, and an amount of feeding of the knife by the feeding mechanism.

17. A knife bending apparatus as set forth in claim 16, wherein a supporting position by a supporting shaft which supports the press roller is relatively variable with respect to a clamping position by the clamping mechanism, and a clamping direction of the press roller relative to the top surface of the surface plate is properly selectively changed.

18. A knife bending apparatus as set forth in claim 16, wherein the bending die which constitutes the bending mechanism is integrally composed of a plate-like member and is further integrally formed to have a hollow groove having edge portions which are made parallel to the both sides of the knife when the knife is caused to pass therethrough roughly at a middle portion thereof with a proper clearance.

19. A knife bending apparatus as set forth in claim 18, wherein the bending die is composed so that a side of one end of the bending die is linked with a drive mechanism which reciprocates in a right angle direction relative to the side portion of the knife, and the other end side thereof is supported by a supporting means which prevents an inclination toward the right angle direction relative to a travelling direction by the drive mechanism.

20. A knife bending apparatus for bending a long and thin plate-like knife having two lateral sides, a blade edge and a back end opposite said blade edge, the apparatus comprising:

a supporting mechanism for slidably supporting said knife at said two lateral sides thereof, a surface plate located adjacent the supporting mechanism, said supporting mechanism holding the blade in such a state that said back end of the knife in a lengthwise direction of the knife thereof is made to run along a top surface of said surface plate;

a clamping mechanism located opposite said surface plate of said supporting mechanism, with a press roller having a groove to fit and insert the blade edge of the knife, said clamping mechanism clamping the blade between the roller and the top surface of the surface plate;

a bending mechanism, which is placed next to, and a required distance from the supporting mechanism, for repeatedly giving a bending force to the knife supported by the supporting mechanism by a bending die which selectively presses the knife from either side thereof so as to selectively bend the blade in opposite directions;

a controlling device for setting a stop time of the bending mechanism at a point of acting on the knife from a commencement of the force on the knife by the bending mechanism to a termination thereof at a required value and causing the bending mechanism to repeatedly perform bending at proper intervals; and a mechanism for feeding the knife from the supporting mechanism whenever a bending process is carried out by the bending mechanism.

21. A knife bending apparatus as set forth in claim 20, wherein a supporting position by a supporting shaft which supports the press roller is relatively variable with respect to a clamping position by the clamping mechanism, and a clamping direction of the press roller relative to the top surface of the surface plate is properly selectively changed.

22. A knife bending apparatus as set forth in claim 20, wherein the bending die which constitutes the bending mechanism is integrally composed of a plate-like member and is further integrally formed to have a hollow groove having edge portions which are made parallel to the both sides of the knife when the knife is caused to pass therethrough roughly at a middle portion thereof with a proper clearance.

23. A knife bending apparatus set forth in claim 22, wherein the bending die is composed so that a side of one end of the bending die is linked with a drive mechanism which reciprocates in a right angle direction relative to the side portion of the knife, and the other end side thereof is supported by a supporting means which prevents an inclination toward the right angle direction relative to a travelling direction by the drive mechanism.

* * * * *